United States Patent [19]

Takamoto et al.

[11] Patent Number: 4,592,410

[45] Date of Patent: Jun. 3, 1986

[54] CONTINUOUS CASTING OF THIN SLABS

[75] Inventors: Tsutomu Takamoto, Minoo; Yasutake Ohhashi, Saga; Hisao Nishimura, Toyonaka; Yutaka Hirata, Saga; Takashi Okazaki; Masahiro Yoshihara, both of Ibaragi, all of Japan

[73] Assignee: Sumitomo Metal Industries, Ltd., Osaka, Japan

[21] Appl. No.: 663,561

[22] Filed: Oct. 22, 1984

[30] Foreign Application Priority Data

Oct. 28, 1983 [JP] Japan ..... 58-203250

[51] Int. Cl.[4] ..... B22D 11/20; B22D 11/18; B22D 11/16

[52] U.S. Cl. ..... 164/453; 164/454; 164/479; 164/482; 164/483

[58] Field of Search ..... 164/155, 413, 427–434, 164/449, 451, 452, 453, 454, 479–482, 483

[56] References Cited

U.S. PATENT DOCUMENTS 3,478,808 11/1969 Adams ..... 164/453
3,921,697 11/1975 Petry ..... 164/432
4,276,921 7/1981 Lemmens et al. ..... 164/449

FOREIGN PATENT DOCUMENTS 47-21331 10/1972 Japan ..... 164/454
55-122659 9/1980 Japan ..... 164/453
602293 4/1978 U.S.S.R. ..... 164/449

*Primary Examiner*—Nicholas P. Godici
*Assistant Examiner*—Richard K. Seidel
*Attorney, Agent, or Firm*—Burns, Doane, Swecker and Mathis

[57] ABSTRACT

A process for continuously casting thin slabs, which comprises the steps of pouring a molten metal from a large-sized tundish through a sliding nozzle into a small-sized tundish, over-flowing the molten metal from the small-sized tundish to pour the molten metal into a continuous casting machine of the twin-belt type is disclosed. According to the process, a pouring rate into the small-sized tundish is calculated prior to overflow on the basis of a change in weight of the small-sized tundish and the degree of opening of the sliding nozzle is adjusted so as to make the calculated pouring rate come close to the target pouring rate into the small-sized tundish or into the casting machine.

6 Claims, 4 Drawing Figures

CONTINUOUS CASTING OF THIN SLABS

BACKGROUND OF THE INVENTION

This invention relates to a process for continuously casting thin slabs, and in particular to a process in which the pulling speed of a solidified slab and the pouring level of a melt in a casting mold are promptly and automatically adjusted to predetermined values during continuous casting through a twin-belt-type continuous casting machine.

Recently, the application of continuous casting to the manufacturing of thin slabs has become widespread. Continuous casting processes have met difficulties including the occurrence of unstable casting conditions, e.g., fluctuations in the molten metal level in a continuous casting mold. This is because the cross section of a thin slab is very small, and even a small fluctuation in casting conditions results in a large variation in the level of molten metal poured into a continuous casting mold.

Furthermore, since an increase in productivity is also desired to lower manufacturing costs, high speed casting is required. Therefore, substantial fluctuations in manufacturing conditions, including the molten metal level in a casting mold, are inevitable.

A prior art process includes the provision of a large-sized tundish positioned below the ladle, a sliding nozzle installed under the bottom of the large-sized tundish, a small-sized tundish postioned below the large-sized tundish, and a continuous casting machine of the twin-belt type (hereunder referred to as a "caster"). The process comprises the steps of pouring a melt first from the ladle to the large-sized tundish and then into the small-sized tundish through the sliding nozzle, overflowing the melt from the small-sized tundish, casting the over-flowed melt into a moving-belt mold of a caster of the twin-belt type, and solidifying the poured melt in the moving-belt mold.

When the melt accumulates in the tundish to overflow, and the starting of pouring of the melt into the caster is visually detected, the operator starts the caster. The operator then gradually increases the pulling speed of the cast slab to a level previously determined in response to the degree of opening of the sliding nozzle at the beginning of pouring the melt into the caster or the pouring rate of the melt into the caster. When the operator notices through a melt-level-monitoring device that the level of the melt has reached a set point of the level of the melt, the operator then stops increasing the operating speed of the caster and maintains the pulling rate of the slab at a constant level. After that, the operator can manually adjust the degree of opening of a sliding nozzle or the pulling rate of the cast slabs so as to keep the level of the molten metal in the mold constant.

However, during the practice of these processes, the interrelation between the pouring rate of the melt into the caster and the degree of opening of the sliding nozzle varies depending on fluctuations or variations of process conditions such as decrease in the diameter of the opening of the sliding nozzle due to the deposition of the melt onto the nozzle opening. Thus, it is quite difficult to determine an interrelation between them definitely.

Therefore, it is frequently experienced that there is a big difference between the real data and the target value of the flowing rate. In these cases, it is usually impossible to make the pulling speed of the caster as well as the molten metal level in the moving-belt mold reach the target ones in one step. A series of frequent adjustments such as mentioned above, must be repeated in order that the real data may approach the target values. In addition, it will take a long period of time to achieve stable conditions for casting. Therefore, the yield as well as the quality of the resulting slabs are not satisfactory. In addition, sometimes troubles occur which might stop the operations, such as a break-out of the caster, overflow of the melt from the caster, etc.

In addition, since the operation conditions of a continuous casting process using the twin-belt type caster are not stable, it is necessary to start up the process carefully. Usually it takes a long period of time before the operation is carried out under stable casting conditions. Sometimes, as already mentioned, a substantial fluctuation in the level of the molten metal poured into the mold is inevitable for a twin-belt type caster.

SUMMARY OF THE INVENTION

One of the objects of this invention is to provide a process for continuously casting slabs which is free from the disadvantages of the prior art such as mentioned hereinbefore.

Another object of this invention is to provide a process for continuously casting thin slabs through a twin-belt type casting machine.

Still another object of this invention is to provide a process for starting up the continuous casting of slabs considerably thin in section through a twin-belt type casting machine.

In one aspect, this invention resides in a process for continuously casting a thin slab, which comprises the steps of pouring a molten metal from a large-sized tundish through a sliding nozzle into a small-sized tundish, and over-flowing the molten metal from the small-sized tundish to pour the molten metal into a continuous casting machine of the twin-belt type, characterized in that:

prior to the starting of charging the molten metal into the continuous casting machine, the weight of the molten metal poured from the large-sized tundish to the small-sized tundish is measured, for example, by means of a load cell installed in the small-sized tundish;

the pouring rate into the small-sized tundish is calculated on the basis of a change in said weight with respect to time;

the degree of opening of the sliding nozzle is adjusted so as to make the calculated pouring rate come close to the target pouring rate;

the pouring rate into the small-sized tundish is calculated in the same manner as mentioned previously after control of the degree of opening of the sliding nozzle;

the start-up pulling rate and the succeeding pulling rate are calculated on the basis of the thus calculated pouring rate; and when the beginning of charging the molten metal into the continuous casting machine is detected, the continuous casting machine is operated at the start-up pulling rate which is previously calculated for a predetermined period of time and then the machine is operated at the constant pulling rate which is also previously calculated.

In another aspect of this invention, the target pouring rate may be the target pouring rate into a casting machine. The calculated pouring rate into the small tundish may be compared with the target pouring rate into the casting machine so as to adjust the degree of opening of the sliding nozzle.

DETAILED DESCRIPTION OF THE PREFERRED EMBODIMENTS

Figure 1:
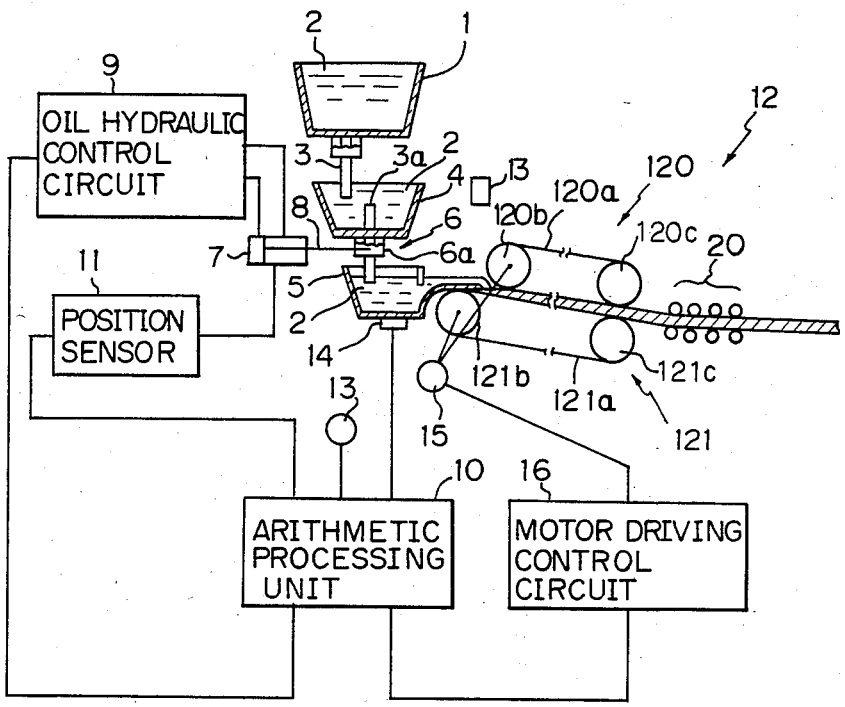
FIG. 1 is a schematic illustration of the system of this invention.

In FIG. 1, a molten metal (molten steel) 2 contained in a ladle 1 is poured by way of a sliding nozzle 3 into a large-sized tundish 4 positioned under the ladle 1. Below the large-sized tundish 4, a small-sized tundish 5 is provided so that the melt 2 is poured into the small-sized tundish 5 by way of a stopper 3*a* in the large-sized tundish 4 and a sliding nozzle 6 provided at the bottom of the large-sized tundish 4.

The sliding nozzle 6 serves to control the flow rate of the melt 2 poured from the large-sized tundish 4 into the small-sized tundish 5. The degree of opening of the sliding nozzle 6 is varied by moving the position of the sliding portion 6*a* with respect to the sliding nozzle 6, and the flow rate of the melt 2 is able to be adjusted by changing the degree of opening. A rod 8 of an oil hydraulic cylinder 7 of the double-acting type is connected to the sliding portion 6*a*. The cylinder 7 is provided with oil chambers each for moving the rod 8 forward and backward. Thus, the movement of the rod 8 serves to shift the sliding portion 6*a* to an opened position and to a closed position. The cylinder is actuated by means of hydraulic pressure supplied from an oil hydraulic control circuit 9 to each of the oil chambers.

The oil hydraulic control circuit 9 comprises a solenoid operated valve, a pressure control circuit, etc. (not shown), through which the rod is moved in accordance with an operating signal given by an arithmetic processing unit 10.

The distance which the rod 8 is moved, i.e. the degree of opening of the sliding portion 6*a* is detected by means of a position sensor 11 attached to the oil hydraulic cylinder 7 and the detected position is given to the arithmetic processing unit 10 as a feedback signal.

There is provided an overflow spout on part of the upper edge of the small-sized tundish 5. After the level of the melt 2 poured into the small-sized tundish 5 reaches a predetermined level, the melt 2 overflows from the overflow spout and is poured into a mold provided in a caster, the casting mold of which is open toward the overflow spout. Above the overflow spout a sensor 13 such as an H.M.D (Hot Metal Detector) is provided. When the overflow of the melt 2 into the caster 12 starts, the sensor 13 detects the starting thereof and gives a signal to the arithmetic processing unit 10.

A load cell 14 is provided at the bottom of the small-sized tundish 5, and the weight of the melt 2 poured thereinto is detected. The detected weight is changed into an electrical signal and is given to the arithmetic processing unit 10 to determine a pouring rate of the melt 2 into the small-sized tundish 5.

The caster 12, as shown in the drawings, comprises an upper belt roll mechanism 120 and a lower belt roll mechanism 121 having a belt 120*a* and a belt 121*a*, respectively, each of which is extended between nip pulleys 120*b*, 121*b* and tension pulleys 120*c*, 121*c*. The belts are arranged so that the melt 2 is poured between the belts 120*a* and 121*a*. The poured melt is cooled and is solidified in a preliminary cooling zone (not shown).

The entrance nip pulleys 120*b*, 121*b* of the lower and upper belt roll mechanisms are connected to a driving motor 15 for these pulleys. By means of the motor 15, the belts 120*a*, 121*a* are driven and the solidified cast slab positioned between the belts 120*a* and 121*a* is transferred to a secondary cooling zone 20 comprising a plurality of rolls positioned downstream of the caster 12. The motor 15 is in communication with the arithmetic processing unit 10 by way of a motor driving control circuit 16, and the rotation is controlled by a driving signal generated from the arithmetic processing unit 10.

Operation of the Caster

The process of this invention is carried out by using the apparatus shown in FIG. 1 in the following fashion.

Prior to charging the melt 2 into the caster 12, an actual pouring rate $Q_{a1}$ of the melt 2 which is poured from the large-sized tundish 4 by way of the sliding nozzle 6 into the small-sized tundish 5 is calculated in accordance with the following equation (1) in the arithmetic processing unit 10:

$$Q_{a1}=k_1\,dW/dt \qquad (1)$$

(wherein $k_1$ is a conversion factor) The weight (W) of the melt 2 in the small-sized tundish 5 and its rate of change with respect to time (dW/dt) are detected by the load cell 14.

Using the thus determined actual pouring rate $Q_{a1}$ and the degree of opening (X) of the sliding nozzle 6 which is detected by the position sensor 11, the interrelation between the degree of opening (X) of the sliding nozzle 6 and the measured pouring rate ($Q_{a1}$) at that time of operation may be determined.

The degree of opening (X) of the sliding nozzle 6 is automatically controlled on the basis of the above interrelation so that the pouring rate $Q_a$ of the melt into the small-sized tundish 5 will reach the target pouring rate $Q_t$ of the melt into the caster 12, i.e., the target pouring rate into the small-sized tundish.

Then the pouring rate ($Q_{a2}$) after adjustment of the degree of opening (X) of the sliding nozzle 6 is calculated in the same manner as shown hereinbefore regarding the calculation of the pouring rate $Q_{a1}$. On the basis of the thus calculated data, the constant pulling rate $V_2$ shown in the following equation (2) is determined.

$$V_2=k_2Q_{a2} \qquad (2)$$

(wherein $K_2$ is a conversion factor)

The constant pulling rate $V_2$ means the pulling rate under steady state conditions following the start-up operations of the caster 12 which are found just after the starting of the caster 12.

At the next stage the start-up pulling rate $V_1$ is calculated on the basis of the above mentioned constant pulling rate $V_2$, which is higher than the rate $V_1$; namely, $V_1=V_2-\alpha$, wherein $\alpha$ is a parameter which is determined such that the pulling rate $V_1$ is not so high as to cause the break-out of the melt, and the parameter $\alpha$ corresponds to an increase in the melt level in the caster 12 during the period of time which the start-up pulling rate $V_1$ is increased to the constant pulling rate $V_2$. The factor $\alpha$ is previously determined according to the casting conditions such as the pulling speed V of the caster 12, the pouring rate Q of the melt to the caster 12, etc.

While the pulling speed is being calculated, the pouring of the melt 2 into the small-sized tundish 5 is continued. The melt 2 overflows from the overflow spout into the caster when the level of the melt reaches a predetermined level in the small-sized tundish. When the sensor 13 detects the beginning of the pouring of the melt into the caster 12, the caster 12 is started. The pulling rate is adjusted to the previously calculated start-up pulling rate $V_1$. After a predetermined period of time $t_a$ passes, the pulling rate is increased to the constant pulling rate $V_2$.

Before starting the operation of the caster, a dummy bar (not shown) is placed between the belts 120*a* and 121*a*. The position where the dummy bar is placed is $l_o = t_a \times \alpha$ lower, i.e., downstream from the target melt level in the caster 12. Thus, after the pulling is carried out at a rate of $V_1$ for a period of time $t_a$, the pulling rate $V_1$ being lower than the constant pulling rate $V_2$ by $\alpha$, the level of the melt in the caster 12 is adjusted to the target level.

In summary, the start-up process of this invention comprises the following steps:

(1) Measuring the weight of the melt in the small-sized tundish;

(2) Calculating the pouring rate of the melt into the small-sized tundish;

(3) Comparing the calculated value with the target pouring rate of the melt into the caster (under stable operating conditions the pouring rate of the melt into the small-sized tundish is substantially the same as the pouring rate of the melt into the caster);

(4) Adjusting the degree of opening of the sliding nozzle on the basis of the results of the above comparison;

(5) Again calculating the pouring rate of the melt into the small-sized tundish by repeating Steps (1) and (2) after adjustment of the degree of opening of the sliding nozzle;

(6) Determining $V_2$, which is the pulling rate of the solidified slab under stable operating conditions, on the basis of the pouring rate of the melt into the small-sized tundish calculated in Step (5) above;

(7) Determining $V_1$, the pulling rate during start-up procedures of the caster, on the basis of the thus determined $V_2$;

(8) Starting the caster at $V_1$ when the pouring of the melt into the caster through the small-sized tundish is detected;

(9) Changing the rate to $V_2$ after a predetermined period of time has elapsed; and

(10) Continuing the casting under stable conditions.

The process of this invention will be further described in conjunction with working examples of this invention, which are presented for illustrative purposes, and which by no means limit this invention.

EXAMPLES

Figure 2:
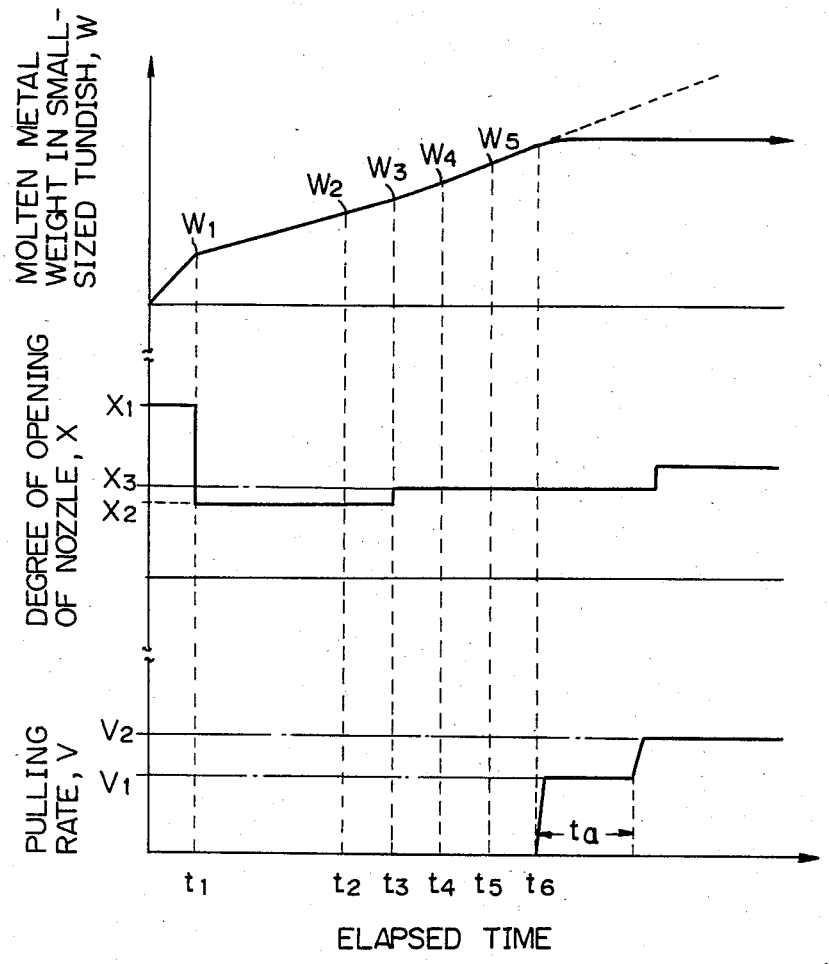
FIG. 2 is a schematic diagram showing the interrelation between the pouring rate of the molten metal into the small-sized tundish and the pulling rate of the caster at the beginning of the process of this invention.

The process of this invention was carried out in accordance with the procedures shown in the time-programming chart of FIG. 2 with time as the abscissa and the weight (W) of the melt 2 in the small-sized tundish 5, the degree of opening (X) of the sliding nozzle 6, and the pulling rate V of the caster as ordinates.

At the very beginning ($t_o$), the sliding nozzle 3 is controlled and the melt is poured from the ladle 1 into the large-sized tundish 4 to a predetermined level. After that, while maintaining the sliding nozzle at its full opening position $X_1$, the stopper nozzle $3_a$ is opened to pour the melt 2 from the large-sized tundish into the small-sized tundish 5.

The reasons why the sliding nozzle 6 is opened to its full opening position $X_1$ were in order that the melt 2 be prevented from adhering to the sliding portion 6*a* and that the operations be done in a short period of time.

At the time $t_1$ when the weight (W) of the melt 2, detected by means of the load cell 14, reaches $W_1$, the degree of opening (X) of the sliding nozzle 6 should be set at a predetermined level $X_2$. For this purpose, the arithmetic processing unit 10 gives an operating command signal to the oil hydraulic control circuit 9 and advances the rod 8 of the oil hydraulic cylinder 7 to decrease the degree of opening (X) of the sliding nozzle 6 to said predetermined level $X_2$. Furthermore, the time difference between the time $t_2$ when the weight (W) of the melt reaches $W_2$ and the time $t_3$ when the weight (W) reaches $W_3$ was calculated, and then the actual pouring rate $Q_{a1}$ during the period of $(t_3 - t_2)$ is calculated on the basis of the following Equation (3):

$$Q_{a1} = k_1(W_3 - W_2)/(t_3 - t_2) \quad (3)$$

Using the thus calculated pouring rate $Q_{a1}$ and the degree of opening ($X_2$) of the sliding nozzle 6 which is detected by the position sensor 11, the interrelation between the pouring rate $Q_a$ and the degree of opening (X) of the sliding nozzle 6 under actual operations is determined, and on the basis of the thus obtained interrelation an operating command signal designed to make the pouring rate $Q_{a1}$ come close to the target pouring rate $Q_t$ is given to the pressure control circuit 9 to adjust the degree of opening (X) of the sliding nozzle 6 to the degree of opening ($X_3$).

Then, the pouring rate (Q) is measured after the degree of opening (X) is controlled as in the above. Namely, the time difference between the time $t_4$ when the weight (W) of the melt measured by the load cell 14 reaches $W_4$ and the time $t_5$ when the weight (W) reaches $W_5$ is first calculated and then the pouring rate $Q_{a2}$ after control of the degree of opening of the sliding nozzle 6 is calculated on the basis of the following Equation (4):

$$Q_{a2} = k_1(W_5 - W_4)/(t_5 - t_4) \quad (4)$$

Using the thus calculated pouring rate $Q_{a2}$ which is the same or is substantially the same as the above-mentioned target pouring rate $Q_t$, the constant pulling speed $V_2$ and then the start-up pulling speed $V_1$ are obtained on the basis of the before-mentioned Equation (2).

When the beginning of the pouring of the melt is reported by the sensor 13 at the time $t_6$, a driving command signal is given to the motor driving control circuit 16 to start the caster 12, the pulling rate of which is set at the start-up pulling speed $V_1$. After pulling the slab, as already mentioned, for a predetermined time $t_a$ at a rate $V_1$, the driving signal necessary to increase the pulling rate (V) to the constant pulling rate $V_2$ is given to the motor driving control circuit 16 so that the pulling rate (V) of the caster 12 is adjusted to the constant pulling rate $V_2$.

As is apparent from the foregoing, according to the process of this invention, the pouring rate from the large-sized tundish into the small-sized tundish is measured, and on the basis of the thus measured value the degree of opening of a sliding nozzle is controlled. Therefore, it is possible to obtain a pouring rate $Q_{a2}$ corresponding to the target pouring rate $Q_t$ by adjusting the degree of opening of the nozzle even when the sliding nozzle is clogged due to the deposition of the melt onto the inner surface thereof. In addition, since the pulling rate is determined on the basis of the actual pouring rate $Q_{a2}$, it is possible to control precisely and promptly the level of the melt in a mold and the pulling rate of a caster to the target values.

The advantages of the process of this invention will be described in conjunction with the accompanying drawings.

Figure 3:
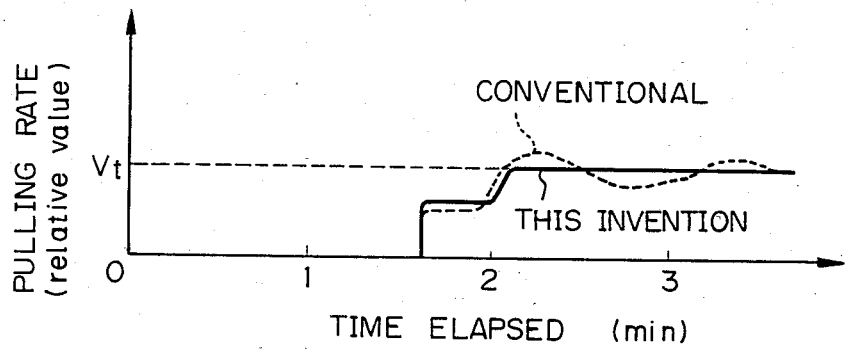
FIGS. 3 and 4 are graphs showing the experimental data obtained in the working examples of this invention.
Figure 4:
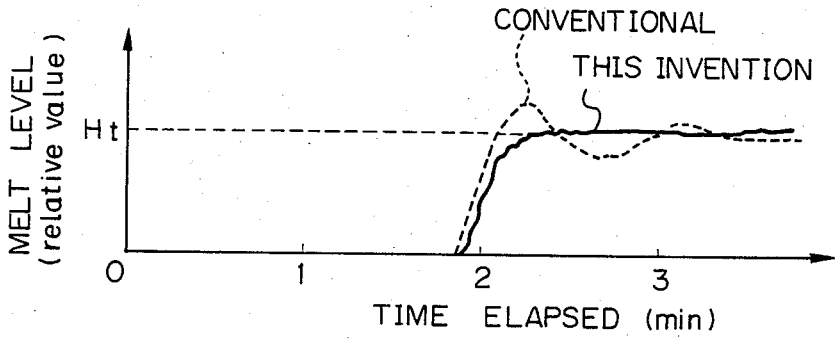

FIG. 3 and FIG. 4 are graphs showing the comparison of the process of this invention to the conventional manual operating process with respect to the control of the pulling rate and the level of the melt, respectively. FIG. 3 shows variation of the pulling rate with respect to time and FIG. 4 shows variation of the level of the melt in the caster with respect to the processing time.

It is apparent from FIG. 3 that according to the conventional process the pulling rate of the slab in the caster fluctuates with respect to the target pulling rate $V_t$ and does not come to a constant level. However, according to the process of this invention, the pulling rate comes to a level in conformity with the target one.

Furthermore, as is apparent from FIG. 4, according to the conventional process the level of the melt deviates within a relatively large range with respect to the target level, $H_t$. On the other hand, according to the process of this invention the level can be adjusted to a level very close to the target one.

The present invention was carried out in accordance with the time-programming chart shown in FIG. 2 and the conventional process was carried out using visual and manual control procedures.

Although this invention has been described with preferred embodiments it is to be understood that variations and modifications may be employed without departing from the concept of this invention as defined in the following claims.

What is claimed is:

1. A method of starting a continuous casting system of the type including a first, large-sized molten metal container; a second, small-sized molten metal container for holding a molten metal supplied from said first container up to a predetermined over-flow level, regulating means for regulating a supply of the molten metal from said first to said second container by adjusting a degree of opening of the regulating means, and casting means for continuously pulling and casting the molten metal over-flowing from said second container upon exceeding said predetermined level, said method comprising the steps of:

supplying molten metal to said first container;

adjusting said degree of opening of the regulating means to a predetermined degree, therby supplying the molten metal from the first to second container;

determining in at least two distinct time instants the weight of the molten metal contained in said second container subsequent to said step of adjusting and before an over-flow time at which the molten metal in said second container reaches said predetermined over-flow level;

calculating a rate of supply of the molten metal from the first to the second container subsequent to said step of adjusting and before said over-flow time on the basis of the weights determined in said step of determining the weight;

determining a relationship between said degree of opening of the regulating means and said rate of supply of the molten metal from the first to the second container on the basis of a relationship between said predetermined degree and the rate of supply of the molten metal calculated in said step of calculating the rate of supply of the molten metal;

calculating an opening degree value of the regulating means corresponding to a target supply rate of the molten metal from the first to the second container, on the basis of said relationship between the degree of the opening and the rate of supply of the molten metal;

readjusting said degree of opening of the regulating means to said opening degree value of the regulating means corresponding to the target supply rate calculated in said opening degree calculation step;

redetermining in at least two distinct time instants a weight of the molten metal contained in said second container after said step of readjusting and before said over-flow time;

recalculating a rate of supply of the molten metal from the first to the second container after said step of readjusting and before said over-flow time on the basis of the weights determined in said step of redetermining a weight;

calculating a start-up pulling rate and succeeding pulling rate of said casting means on the basis of the rate of supply of the molten metal from the first to the second container calculated in said step of recalculating the rate of supply of the moten metal;

detecting a begining of an over-flow of the molten metal from the second container upon reaching said predetermined level; and pulling and casting the molten metal over-flowing from said second container at said start-up rate for a predetermined length of time, and then at a said succeeding pulling rate by said casting means.

2. A method as claimed in claim 1, wherein said step of adjusting the degree of opening includes actuating a sliding nozzle.

3. A method as claimed in claim 1, wherein said steps of determining and redetermining the weight of the molten metal include determining the weight of said second container containing the molten metal by using a load cell disposed on the second container.

4. A method as claimed in claim 1, wherein said adjusting and readjusting include detecting a position of a cylinder rod connected to a sliding member of a sliding nozzle by a position sensor, and adjusting the degree of opening of the sliding nozzle in response to the position of the cylinder rod detected in the position detecting step.

5. A method as claimed in claim 1, further comprising closing said regulating means before said step of supplying the molten metal to the first container by positioning a stopper in the opening of the regulating means, a preliminary step of adjusting the degree of opening of the regulating means to a full opening position, and, after said step of supplying the molten metal of the first container and before the first step of adjusting the degree of opening, a step of removing said stopper from the opening of the regulating means, thereby opening the regulating means and supplying the molten metal from the first to the second container with the opening of the regulating means at the full opening position before said first step of adjusting the degree of opening of the regulating means.

6. A method as claimed in claim 1, including the step of casting with a continuous casting machine of the twin belt type.

* * * * *